United States Patent [19]

Spamer

[11] Patent Number: 5,039,002

[45] Date of Patent: Aug. 13, 1991

[54] ARTICLE DISPLAY CASE

[75] Inventor: William S. Spamer, Roswell, Ga.

[73] Assignee: The Mead Corporation, Dayton, Ohio

[21] Appl. No.: 517,819

[22] Filed: May 2, 1990

[51] Int. Cl.[5] ..... B65D 5/48

[52] U.S. Cl. ..... 229/120.08; 229/23 A; 229/40; 229/199; 229/915; 229/DIG. 11

[58] Field of Search ..... 206/427; 229/120.08, 229/120.11, 23 A, 40, 199, 915, DIG. 11; 220/651

[56] References Cited

U.S. PATENT DOCUMENTS

| | | | |
|---|---|---|---|
| 1,944,305 | 1/1934 | Schmidt | 229/199 |
| 2,459,921 | 1/1949 | Comer | 206/427 |
| 3,257,064 | 6/1966 | Davis | 206/427 |
| 3,287,075 | 11/1966 | Batke et al. | 229/DIG. 11 |
| 3,343,665 | 9/1967 | Marino | 229/120.08 |
| 3,677,458 | 7/1972 | Gosling | 206/427 |
| 4,126,264 | 11/1978 | Cohen | 229/120.08 |
| 4,694,987 | 9/1987 | Forbes, Jr. | 229/120.08 |
| 4,913,291 | 4/1990 | Schuster | 229/120.11 |

FOREIGN PATENT DOCUMENTS

| | | | |
|---|---|---|---|
| 200130 | 11/1935 | Australia | 229/120.11 |
| 639448 | 4/1962 | Canada | 229/DIG. 11 |
| 40075 | 11/1965 | German Democratic Rep. | 229/120.08 |

*Primary Examiner*—Gary E. Elkins
*Attorney, Agent, or Firm*—Rodgers & Rodgers

[57] ABSTRACT

A case for displaying articles in retail outlets includes a bottom wall, side walls foldably joined respectively to side edges of the bottom wall, top wall panels foldably joined respectively to the top edges of the side walls and with their inner edges disposed in close juxtaposition to each other to form a cover for the case, a pair of face contacting medial panels foldably joined respectively to the inner edges of the top wall panels, and interlocking structure interconnecting the bottom edges of the medial panels with the bottom wall. The case is formed preferably of corrugated plastic or paperboard material.

23 Claims, 4 Drawing Sheets

ARTICLE DISPLAY CASE

TECHNICAL FIELD

This invention relates to displaying articles at points of sale and for transporting such articles from an original vendor to a merchandising establishment.

BACKGROUND ART

Many types of article display cases are well known which are stacked one atop another and which rely on the packaged articles for support of the stacked cases. Such cases do not permit removal of an article from a case in a lower tier of cases and do not permit the display of a variety of sizes and types of containers in a tier.

SUMMARY OF THE INVENTION

According to this invention in one form, an article display case formed of corrugated plastic or paperboard material includes a bottom wall, side walls foldably joined respectively to opposite side edges of said bottom wall, top wall panels of similar size and configuration foldably joined respectively to the top edges of said side walls and with their inner edges disposed in close juxtaposition to each other to form a cover for the case, a pair of face contacting medial panels foldably joined respectively to said inner edges of said top wall panels and interlocking means interconnecting the bottom edges of said medial panels with said bottom wall.

To provide mechanical strength, certain edges of the case panels are doubled back on themselves and in certain applications of the invention a reinforcing frame is incorporated within the case and some or all of its reinforcing elements are encapsulated within folded back edge portions of the case.

BEST MODE OF CARRYING OUT THE INVENTION

Figures 6, 6A:
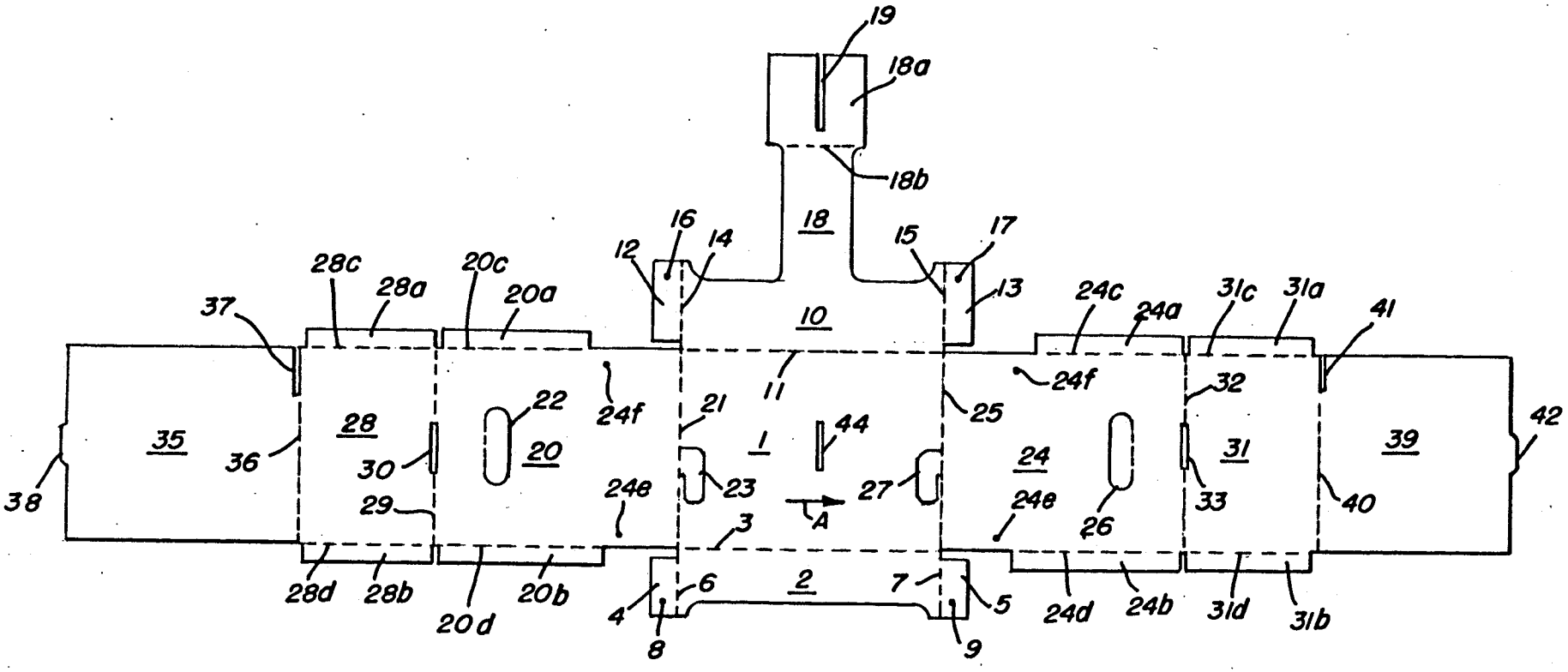
FIG. 6 is a plan view of a blank from which a case is formed according to this invention as viewed from the inside surface thereof.
FIG. 6*a* is a plan view of a bottom wall of the case which is inserted into the case and which is disposed atop the main bottom wall.

With reference to FIG. 6, the numeral 1 designates a bottom wall to which a supplementary panel 2 is foldably joined along fold line 3. End flaps 4 and 5 are foldably joined to supplementary panel 2 along fold lines 6 and 7 respectively. Apertures 8 and 9 are formed in end flaps 4 and 5 respectively.

On the other side of the blank, a supplementary panel 10 is foldably joined to bottom wall 1 along fold line 11 and end flaps 12 and 13 are foldably joined to the end edges of supplementary panel 10 along fold lines 14 and 15 respectively. Apertures 16 and 17 are formed in end flaps 12 and 13 respectively. A reinforcing strip 18 is integrally formed with supplementary panel 10 and includes a slot 19 formed in its outer portion 18*a* which is foldably joined to the reinforcing strip 18 along fold line 18*b*.

Side wall 20 is foldably joined to bottom wall 1 along fold line 21 and includes a hand gripping aperture 22. A locking tab 23 is struck from bottom wall 1 and foldably joined to side wall 20 along fold line 21.

Side wall 24 is foldably joined to bottom wall 1 along fold line 25 and a hand gripping aperture 26 is formed in side wall 24. A locking tab 27 is struck from bottom wall 1 and is foldably joined to side wall 24 along fold line 25.

Top wall panel 28 is foldably joined to side wall panel 20 along fold line 29 and includes a locking slot 30 struck from top wall panel 28 adjacent the fold line 29. Top wall panel 31 is foldably joined to side wall panel 24 along fold line 32 and includes a locking slot 33.

End portions 28*a* and 28*b* of top wall panel 28 are foldably joined to that panel along fold lines 28*c* and 28*d* respectively. These panels are arranged to be doubled back onto top wall panel 28 so as to afford reinforcement for that panel. In like fashion, side wall panel 20 includes end strips 20*a* and 20*b* which are foldably joined to the ends of side wall 20 along fold lines 20*c* and 20*d*. In like fashion at the other end of the blank, side wall 24 includes reinforcing strips to be doubled back and designated 24*a* and 24*b* while top wall panel 31 includes structure 31*a*, 31*c*, 31*b* and 31*d*.

Medial panel 35 is foldably joined to top wall panel 28 along fold line 36 and is provided with a notch 37 and an interlocking element 38. Similarly at the other end of the blank, a medial panel 39 is foldably joined to top wall panel 31 along a fold line 40 and is provided with a notch 41 and an interlocking element 42.

According to a feature of this invention, the fluting of the corrugated material from which the blank is formed extends from left to right as indicated by the arrow A. For reinforcing the bottom structure of the case, a separate bottom wall 43 is provided as shown in FIG. 6*a* and fluting for the bottom wall extends in the direction of the arrow A1 as indicated in FIG. 6*a*. Locking aperture 44 is formed medially in bottom wall 1 and a complementary locking aperture 45 is formed in separate bottom wall 43.

For some applications of the invention, it may be desirable to use the case as a transporting device as well as a displaying device. In this event, the case is well adapted for loading from above. As is evident from FIGS. 4 and 5, the separate bottom wall 43 is first inserted into overlying relationship with respect to the bottom wall 1 with the locking slots 44 and 45 disposed in coincidence with each other. After articles are partially or fully loaded into the case, the top wall panels 28 and 31 are folded into horizontal positions and the medial panels 35 and 39 are lowered downwardly into perpendicular relation with the bottom wall 44, 45 so that the locking tabs 38 and 42 which are disposed in close proximity to each other may then enter the locking slots 44 and 45.

Figure 3:
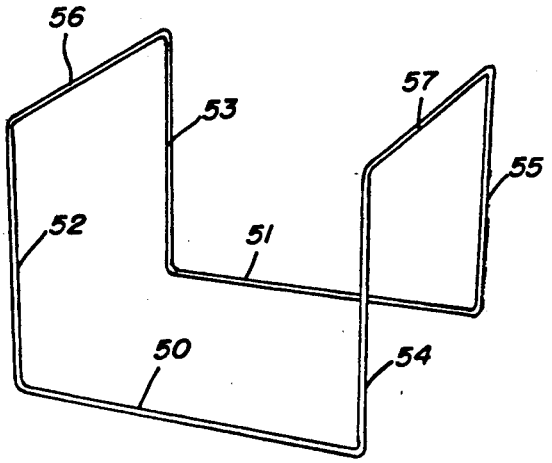
FIG. 3 is a perspective view of a metallic frame including interconnected rods for reinforcing the case according to one feature of the invention.
Figure 4:
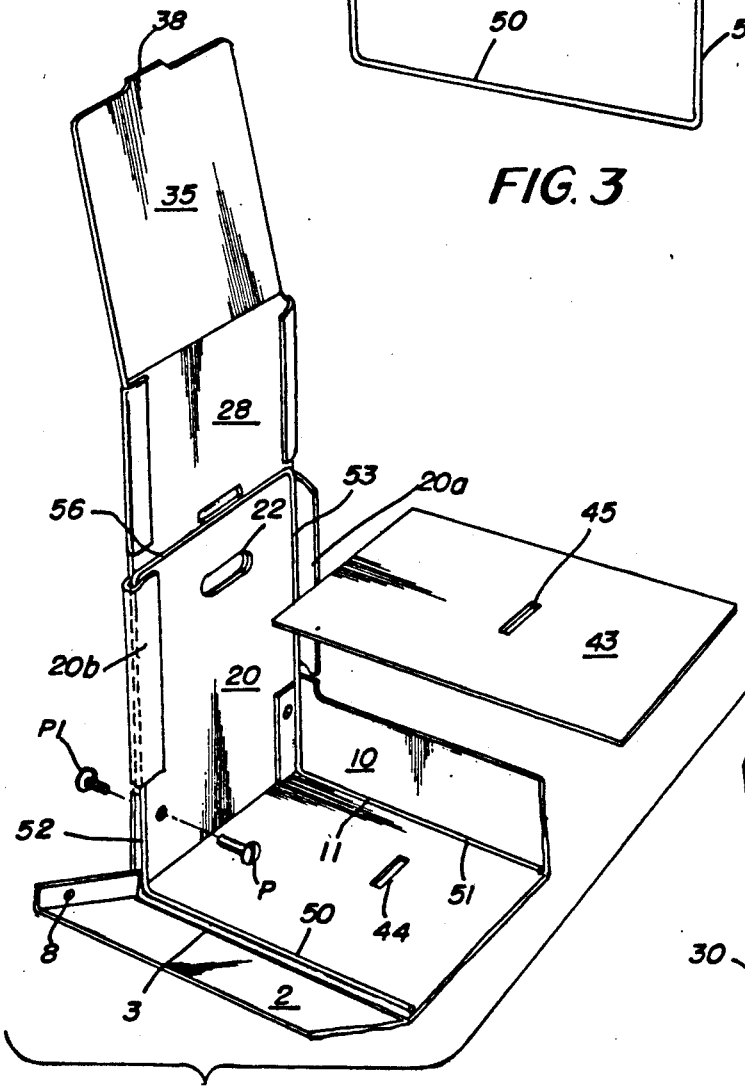
FIG. 4 is an exploded perspective view of parts of a case and with certain parts broken away.

For heavy duty applications of the invention, it is desirable to employ a reinforcing frame such as that indicated in FIG. 3 which includes parallel horizontal lower rods 50 and 51 the ends of which are integrally formed with vertical rods 52, 53, 54 and 55. The upper ends of the vertical rods 52, 53, 54 and 55 are interconnected by horizontal parallel rods 56 and 57 as shown in FIG. 3. If the reinforcing frame of FIG. 3 is to be used as shown in FIG. 4, the lower horizontal rod 50 is placed along the fold line 3 between bottom wall 1 and supplementary panel 2 and the lower reinforcing rod 51 is placed along the fold line 11 between the supplementary panel 10 and the bottom wall 1 as indicated in FIG. 4. Vertical reinforcing rod 52 is encapsulated within the doubled back reinforcing strip **20*b* and the side wall 20 while vertical reinforcing rod 53 is encapsulated between the reinforcing strip 20*a* and the side wall 20 as is indicated in the process of formation in FIG. 4. Reinforcing strips 20*a*, 20*b*, 24*a* and 24*b* add vertical strength and provide a smooth edge at the front of the case and also cover the associated rod. Upper horizontal reinforcing rod 56 is interconnected at its ends with the upper ends of reinforcing rods 52 and 53 and is disposed along the fold line 29 between side wall 20 and top wall panel 28. Obviously the reinforcing rods 54, 55 and 57 are interrelated with structure at the other side of the case as is obvious from FIGS. 4 and 5**.

For some applications of the invention, it may not be necessary to incorporate the upper horizontal reinforcing rods 56 and 57 or in the lower horizontal rods 50 and 51 in which event the vertical reinforcing rods 52–55 suffice to lend adequate stability to the structure.

Figure 1:
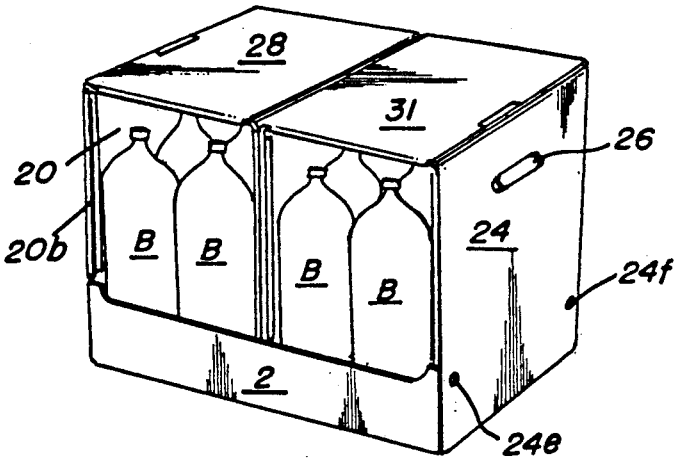
FIG. 1 is a perspective view of a case formed according to one form of the invention.
Figure 2:
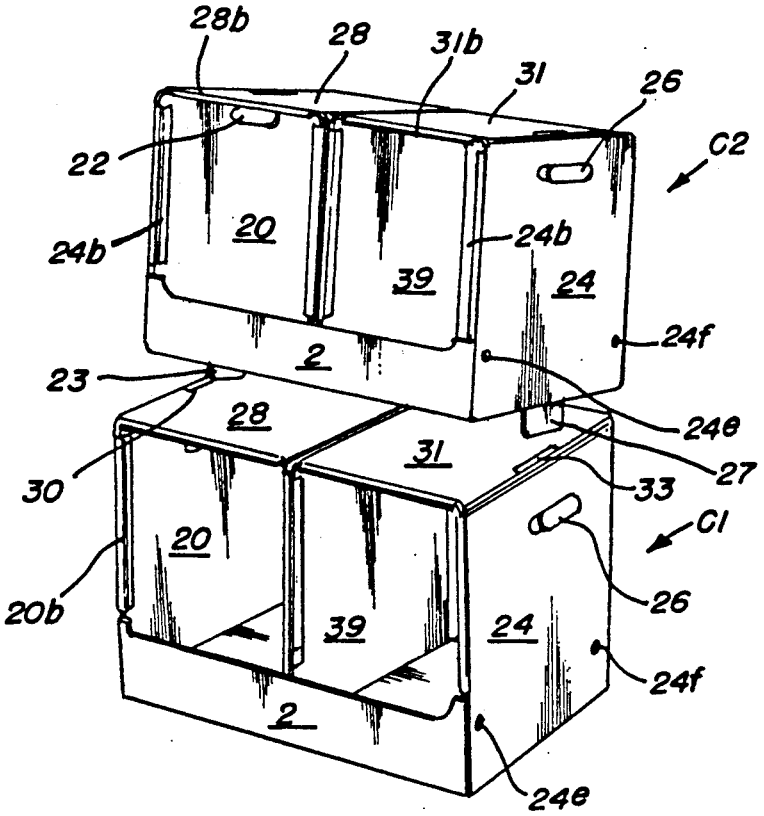
FIG. 2 illustrates two cases such as are shown in FIG. 1 arranged for stacking one above the other.
Figure 5:
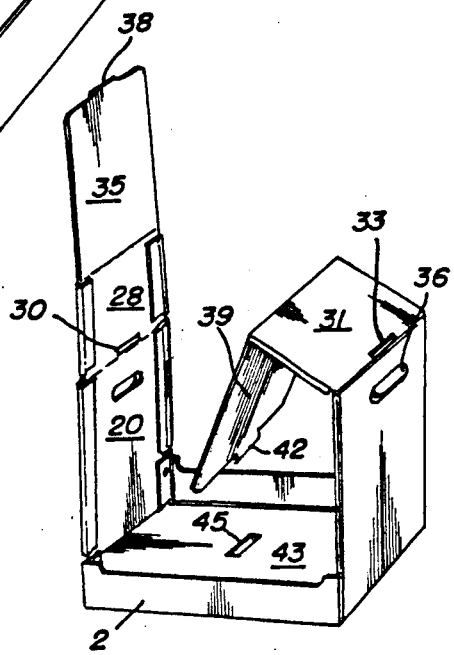
FIG. 5 is a view similar to FIG. 4 but which shows an advanced stage of formation of the case.

Supplementary panel 2 is folded upwardly along the fold line 3 until the aperture 8 comes into coincidence with aperture **20*e* formed in side wall 20 and pivot pin P and P1 of known construction enter these coincident apertures and together with suitable application of adhesive secure the supplementary panel 2 in position as shown for example in FIGS. 1, 2 and 5. In like fashion, the end flap 5 is secured through its aperture 9 and aperture 24*e* in side wall 24 by pins such as P and P1 which are shown in the drawing only in connection with aperture 18. In like fashion, end flaps 12 and 13 are secured to the inner surfaces of side walls 20 and 24** as is obvious.

In order to complete the assembly, the reinforcing strip 18 is manipulated so that its end portion **18*a* having slot 19 therein is folded inwardly so that the portion 18*a* lies in flat face contacting relation with the inner surface of the top wall panels 28 and 31, the slot 19 being arranged to envelope the face contacting medial panels 35 and 39 and the portion of reinforcing strip 18 which is adjacent the fold line 18*b* is disposed within the notches 37 and 41 formed respectively in medial panels 35 and 39**.

For imparting a measure of stability to a stack of cases arranged one atop another, and as is shown in FIG. 2, the L-shaped locking tab 23 of case C2 is arranged for insertion into the locking slot 30 in case C1. Similarly the L-shaped locking tab 27 of case C2 is disposed for insertion into the locking slot 33 formed in top wall panel 31 of case C1. The L-shaped configuration of locking tabs 23 and 27 enhances the security of these interlocking relationships. The stacked and filled units may also be wrapped with a stabilizing film or strap to afford an added measure of strength during handling and shipment where the case is used as a transporting device.

Figure 7:
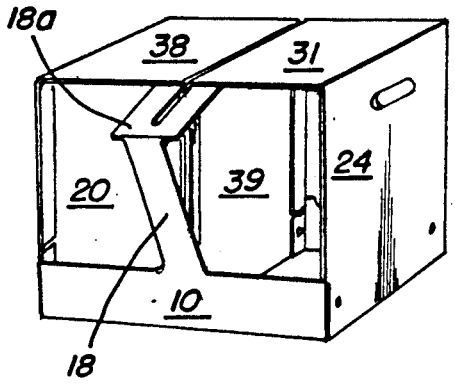
FIG. 7 is a view similar to FIG. 1 but which shows a medial reinforcing panel in the process of being assembled.

FIG. 7 simply shows an intermediate stage of manipulating the reinforcing strip 18 into assembled position with its end portion **18*a* disposed in flat face contacting relation with the lower surface of top wall panels 31 and 38**.

Figure 9:
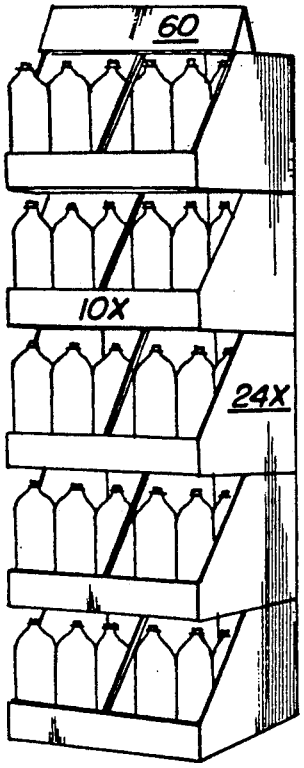
FIG. 9 is a view illustrating a number of cases such as are shown in FIG. 8 stacked one atop another and which clearly indicates that access to the displayed items at all levels is afforded as well as easy viewing.
Figure 8:
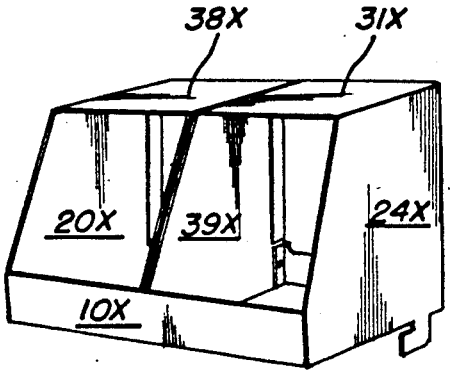
FIG. 8 is a view similar to FIG. 1 but which shows a slightly different configuration of the side walls, the top panels and of the medial panels to improve the view and access to the displayed articles.

FIG. 8 simply shows a somewhat different configuration of the side walls 24X, the top wall panels 31X and 38X and the medial panels 39X whereby added visibility and access is afforded and FIG. 9 simply shows a high stack of items using the structure of FIG. 8. If desired an advertising header 60 may be used and can be secured atop the stack by double face adhesive tape which allows removal from a top depleted case followed by mounting on the case immediately therebelow.

A case formed according to this invention is economical to make and to use and is re-useable. It is also mechanically strong and when stacked in tiers, an unusually sturdy structure is provided to display a wide variety of articles of different sizes thereby to aid purchasers in easily selecting a product well suited to their needs. The case also affords large billboard space on the side walls and on the reinforcing strip.

I claim:

1. An article display case having lower front and back portions comprising a bottom wall having front and back edges, side walls having bottom and top edges and foldably joined respectively along their bottom edges to opposite side edges of said bottom wall, top wall panels each having front, back, outer and inner edges and being of similar size and configuration and foldably joined by fold lines respectively along their outer edges to the top edges of said side walls and with their inner edges disposed in close juxtaposition to each other to form a cover for the case, a pair of face contacting medial panels each having front, top and bottom edges and being foldably joined respectively along their top edges to said inner edges of said top wall panels, and interlocking means interconnecting the bottom edges of said medial panels with said bottom wall.

2. A case according to claim 1 wherein a locking tab is struck from said bottom wall immediately adjacent at least one edge thereof.

3. A case according to claim 2 wherein a pair of locking tabs are struck respectively from said bottom wall immediately adjacent opposite side edges thereof.

4. A case according to claim 3 wherein said locking tabs are foldably joined respectively to bottom edges of said side walls and are of L-shaped configuration.

5. A case according to claim 4 wherein a complementary locking slot is formed in each of said top wall panels which is in vertical coincidence with each of said locking tabs.

6. A case according to claim 1 wherein supplementary panels each having top and end edges are foldably joined along fold lines to the front and back edges of said bottom wall and are configured to form closures for the lower front and back portions of the case.

7. A case according to claim 6 wherein end flaps are foldably joined to the end edges of said supplementary panels and are secured in flat face contacting relation with adjacent areas of said side walls.

8. A case according to claim 7 wherein said end flaps are secured to inner surfaces of said side walls.

9. A case according to claim 1 wherein the front and back edges of said top wall panels are doubled back on themselves to afford reinforcement therefor.

10. A case according to claim 9 wherein said front and back edges are secured in flat face contacting relation to the associated top wall panels.

11. A case according to claim 6 wherein front and back edges of said side walls which are above said front and back panels are doubled back on themselves.

12. A case according to claim 11 wherein said doubled back front and back edges are secured in flat face contacting relation to the associated side walls.

13. A case according to claim 1 and which is formed from a unitary blank wherein said bottom wall, said side walls, said top wall panels, and said medial panels are arranged in series and formed of corrugated material having fluting which is continuous throughout the length of said blank.

14. A case according to claim 13 wherein a separate bottom wall is disposed in coincident overlying relation with said bottom wall and is formed of corrugated material having fluting which is disposed in perpendicular relation to the fluting of said bottom wall.

15. A case according to claim 14 wherein a medial aperture is formed in said separate bottom wall for receiving said interlocking means.

16. A case according to claim 6 wherein a reinforcing strip having an upper portion is formed integrally with the top edge of at least one of said supplementary panels and disposed in close contact with the front edges of said medial panels and wherein the upper portion of said reinforcing strip includes a slot and is folded underneath said top wall panels with the face contacting medial panels disposed within said slot.

17. A case according to claim 16 wherein a notch is formed in each of said medial panels in the top edges thereof and arranged to receive a part of said reinforcing strip.

18. A case according to claim 11 wherein a pair of horizontal reinforcing lower rods are disposed inside the case at the fold line between said bottom wall and each of said supplementary panels, and a vertical reinforcing rod having upper and lower ends integral with each end of each of said horizontal reinforcing lower rods and respectively encapsulated within the doubled back front and back edges of the parts of said side walls which are disposed above said supplementary front and back panels.

19. A case according to claim 18 wherein a horizontal reinforcing upper rod is disposed inside the case at the fold line between each of said side walls and the associated top wall panel and wherein each end of each of said horizontal reinforcing upper rods is integral respectively with the upper end of an adjacent one of said vertical rods.

20. A case according to claim 11 wherein a vertical reinforcing rod is disposed inside each corner of the case and encapsulated within the doubled back front and back edges of said side walls which are disposed above said supplementary front and back panels.

21. A vertical stack of display cases each formed according to claim 5.

22. A vertical stack of loaded display cases each formed according to claim 1 wherein a stabilizing film is wrapped about the stack.

23. A vertical stack of loaded display cases each formed according to claim 1 wherein an advertising header is mounted atop the stack and secured thereto by double face adhesive tape.

* * * * *